US005143050A

United States Patent [19]

Spivey

[11] Patent Number: 5,143,050

[45] Date of Patent: Sep. 1, 1992

[54] WATER HEATER HEAT ROLLOUT SENSOR

[75] Inventor: Michael E. Spivey, Hartsville, S.C.

[73] Assignee: AOS Holding Company, Wilmington, Del.

[21] Appl. No.: 698,706

[22] Filed: May 10, 1991

[51] Int. Cl.[5] ..... F23N 5/24

[52] U.S. Cl. ..... 126/374; 431/16

[58] Field of Search ..... 236/93 R, DIG. 6; 431/22, 4, 16; 137/75, 76; 126/374

[56] References Cited

U.S. PATENT DOCUMENTS

| | | | |
|---|---|---|---|
| 2,130,175 | 9/1938 | Betz | 431/22 |
| 2,140,466 | 12/1938 | Beltz et al. | 158/117.1 |
| 2,269,863 | 1/1942 | Shaw | 236/DIG. 6 |
| 2,273,381 | 2/1942 | Shaw | 236/DIG. 6 |
| 2,488,330 | 11/1949 | Robinson | 431/22 |
| 2,518,804 | 8/1950 | Marvin | 431/22 |
| 3,473,544 | 10/1969 | Nielsen | 431/21 |
| 3,537,803 | 11/1970 | Ignazio | 431/22 |
| 3,652,195 | 3/1972 | McIntosh | 431/21 |
| 3,800,816 | 4/1974 | Follett | 431/21 X |
| 3,908,898 | 9/1975 | Dykzeul | 236/21 B |
| 3,992,137 | 11/1976 | Streisel | 431/278 |
| 4,089,632 | 5/1978 | Rexroad | 431/22 |
| 4,204,833 | 5/1980 | Kmetz | 431/22 |
| 4,401,425 | 8/1983 | Gable | 431/22 |
| 4,437,829 | 3/1984 | Baker | 431/22 |
| 4,745,940 | 5/1988 | Ely | 137/75 X |
| 4,751,912 | 6/1988 | Monette | 126/307 A |
| 4,777,933 | 10/1988 | Ruark | 126/361 |
| 4,984,981 | 1/1991 | Pottebaum | 431/80 |

*Primary Examiner*—William E. Wayner

*Attorney, Agent, or Firm*—David R. Price; James Earl Lowe, Jr.

[57] ABSTRACT

A water heater comprising a combination chamber, a gas burner located in the combustion chamber, a gas inlet pipe communicating with the burner, a gas valve for opening and closing the inlet pipe, and a sensor which is in contact with the inlet pipe and which is operably conneted to the gas valve for closing the valve when the temperature of the pipe exceeds a predetermined temperature.

10 Claims, 1 Drawing Sheet

WATER HEATER HEAT ROLLOUT SENSOR

BACKGROUND OF THE INVENTION

The invention relates to water heaters, and more particularly to heat rollout sensors for domestic water heaters.

"Heat rollout" is the condition of leakage of excessive heat from the combustion chamber of a water heater. This condition can be caused, for example, by an obstruction in the exhaust pipe of the water heater.

It is known to use a heat rollout sensor that monitors the temperature of the air at a given point in relation to the combustion chamber in order to detect heat rollout. Such a sensor causes an interruption of gas flow to the gas burner when heat rollout is sufficient to cause danger of ignition of combustibles in the vicinity of the heater. See, for example, the sensing device 20 in U.S. Pat. No. 3,537,803 to Ignazio.

SUMMARY OF THE INVENTION

A disadvantage of known heat rollout sensors is a relatively high number of "false alarms." In other words, known sensors can stop the flow of gas to the gas burner in response to conditions other than potentially dangerous heat rollout. For example, a harmless momentary increase of the temperature outside the combustion chamber can trigger known heat rollout sensors. "False alarms" are undesirable because they lower the efficiency of a water heater and, if the heat rollout sensor does not automatically reset, require unnecessary service to the water heater.

The invention provides a heat rollout sensor that is less apt to produce "false alarms." Specifically, the invention provides a water heater comprising a gas burner located in a combustion chamber, a gas inlet pipe for supplying gas to the burner, a gas valve for opening and closing the pipe, and a heat rollout sensor which is in contact with the gas inlet pipe and which is operably connected to the gas valve for closing the valve when the temperature of the pipe exceeds a predetermined temperature. It has been found that the temperature of the gas inlet pipe, which extends into the combustion chamber and which becomes heated in the event of heat rollout, provides a more accurate indication of true heat rollout than does the temperature of the air external to the combustion chamber. A sensor monitoring the temperature of the gas inlet pipe will not cause a shutdown in the event of a harmless momentary increase in the temperature of the air external to the combustion chamber.

In the preferred embodiment of the invention, the water heater further comprises an outer jacket which surrounds the combustion chamber and which has therein an access opening, and a door closing the access opening. The gas inlet pipe extends either through the door or between the door and the outer jacket, and the sensor is located approximately two inches above the door, exteriorly of the outer jacket. The water heater also comprises a conventional thermocouple located within the combustion chamber, and the sensor includes a switch which is connected in series with the thermocouple and which opens when the temperature of the pipe exceeds the predetermined temperature. Opening of the switch breaks the thermocouple circuit and thereby closes the gas valve.

Other features and advantages of the invention will become known to those skilled in the art upon review of the following detailed description, claims and drawings.

Figure 1:
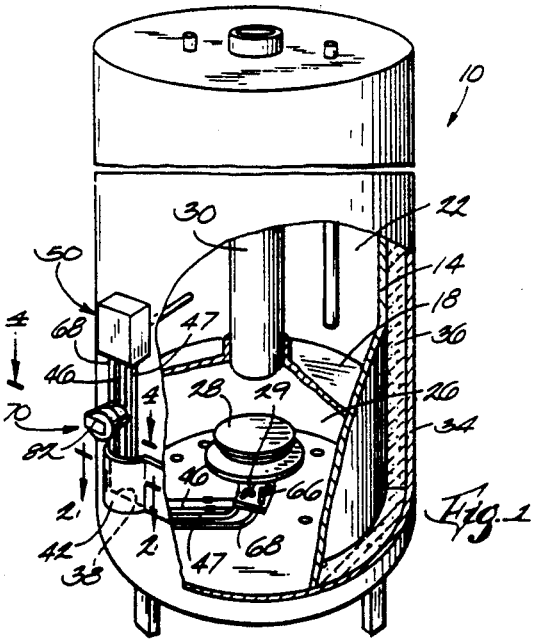
FIG. 1 is a perspective view, partially broken away, of a water heater embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A water heater 10 embodying the invention is illustrated in the drawings. Except as described below, the water heater 10 is substantially identical to the water heaters disclosed in U.S. Pat. Nos. 4,777,933 and 3,992,137, both of which are assigned to the assignee hereof and which are incorporated herein by reference.

The water heater 10 comprises (see FIG. 1) a generally cylindrical tank 14 divided by a lower head 18 into a water chamber 22 above the head 18 and a combustion chamber 26 beneath the head 18. The water heater 10 further comprises a gas burner 28 and a pilot light 29 located in the combustion chamber 26. The water heater 10 also comprises a flue 30 extending through the water chamber 22 and having a lower end communicating with the combustion chamber 26. The water heater 10 further comprises an outer jacket 34 surrounding the tank 14 and the combustion chamber 26. A layer of insulation 36 separates the outer jacket 34 from the tank 14. The outer jacket 34 has therein (see FIGS. 1 and 2) an opening 38 affording access to the combustion chamber 26 and to the gas burner 28, and the water heater 10 also comprises a door 42 closing the access opening 38.

Figure 2:
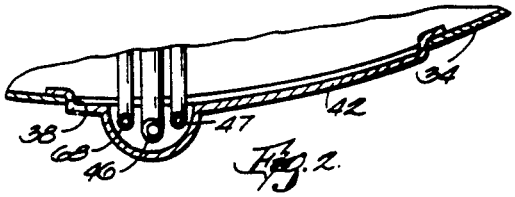
FIG. 2 is a view taken along line 2—2 in FIG. 1.

The water heater 10 also comprises means for supplying gas to the burner 28 and to the pilot light 29. This means preferably includes a gas conduit or inlet pipe 46 communicating with the burner 28 and a pilot line or conduit 47 communication with the pilot light 29. As shown in FIG. 2, the gas inlet pipe 46 and the pilot line 47 extend between the access door 42 and the outer jacket 34 and extend through the access opening 38 and into the combustion chamber 26. As shown in FIG. 1, the outer ends of the inlet pipe 46 and the pilot line 47 extend exteriorly of the outer jacket 34.

Figure 3:
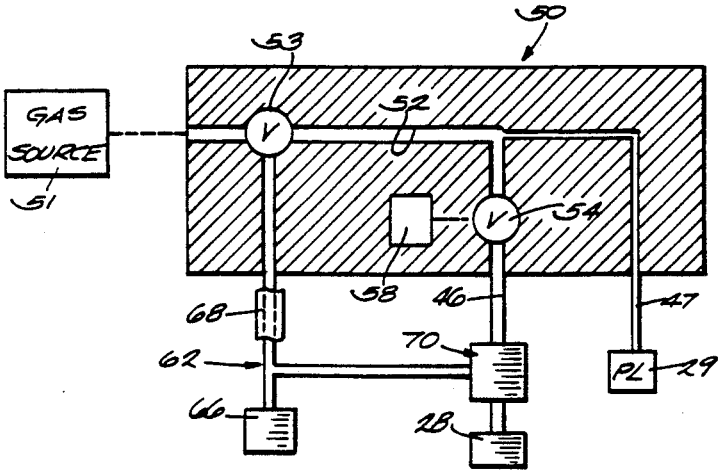
FIG. 3 is a schematic view of the thermostat and gas valve assembly and the electrical circuit of the water heater.

The means for supplying gas to the burner 28 and to the pilot light 29 also includes means for supplying gas to the gas inlet pipe 46 and to the pilot line 47. Such means preferably includes (see FIGS. 1 and 3) a conventional thermostat and gas valve assembly 50 communicating with a gas source 51 (shown schematically in FIG. 3). The assembly 50 includes (see FIG. 3) a gas passageway 52 communicating with both the pipe 46 and the line 47, and an electrically operated gas valve 53 (shown schematically) which is located upstream of the pipe 46 and the line 47 and which opens and closes the passageway 52 and thereby the pipe 46 and the line 47 so as to control gas flow to the burner 28 and to the pilot light 29. The valve 53 remains open when an electrical current is applied to the valve 53 and closes in the absence of a current. The assembly 50 also includes a gas valve 54 (shown schematically) which is located downstream of the valve 53 and which opens and closes the pipe 46. The gas valve 54 is operated by a thermostat 58 (shown schematically) which monitors the temperature of the water within the water chamber 22 and which opens the valve 54 when the water temperature is below a certain temperature. Such a gas valve and thermostat assembly is disclosed in U.S. Pat. No. 3,908,898, which is incorporated herein by reference.

The water heater 10 also comprises (see FIG. 3) an electrical circuit 62 including the valve 53 and a thermocouple 66 (shown schematically in FIG. 3) located in the combustion chamber 26 and adjacent the pilot light 29. The thermocouple 66 is connected to the valve 53 via a thermocouple line 68 (FIGS. 1 and 3) running parallel to the gas pipe 46. The thermocouple 66 generates an electrical current and thereby causes the valve 53 to remain open when the pilot light 29 is on. The thermocouple 66 does not generate a current when the pilot light 29 is not on, so that the valve 53 is closed when the pilot light 29 is not on. When the valve 53 is closed, gas does not flow through the gas pipe 46 regardless of the condition of the valve 54. Thus, the thermocouple 66 overrides the thermostat 58. The water heater 10 as thus far described is conventional.

The water heater 10 further comprises means in contact with the gas supplying means for disabling the supplying means when the temperature of the gas supplying means exceeds a predetermined temperature. While various suitable means can be employed, in the illustrated construction, such means includes (see FIGS. 1 and 3–5) a sensor 70 which is in contact with the inlet pipe 46 and which is operably connected to the gas valve 53 for closing the valve 53 when the temperature of the pipe 46 exceeds the predetermined temperature. The sensor 70 is preferably located approximately two inches above the door 42, exteriorly of the outer jacket 34.

Figure 4:
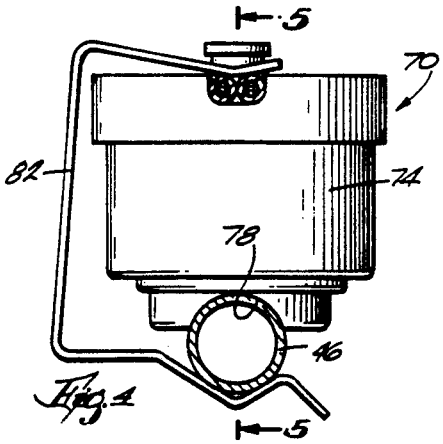
FIG. 4 is a view taken along line 4—4 in FIG. 2.
Figure 5:
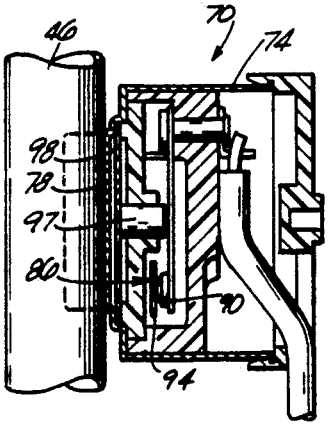
FIG. 5 is a view taken along line 5—5 in FIG. 4.

The sensor 70 is preferably a Type 37T sensor manufactured by Therm-O-Disc Inc. of Mansfield, Ohio. As shown in FIGS. 4 and 5, the sensor 70 includes a housing 74 with an inner portion having therein (see FIG. 4) a semi-cylindrical recess 78 through which the pipe 46 extends. The housing 74 is secured to the pipe 46 by a clamp 82 (FIGS. 1 and 4). The housing 74 contains (see FIG. 5) a switch 86 which includes a moveable contact 90 and a fixed contact 94 and which is connected in the circuit 62 in series with the thermocouple 66 and with the valve 53 so that the circuit 62 is opened when the switch 86 is opened. The gas valve 53 is therefore closed when the switch 86 opens. The sensor 70 also includes (see FIG. 5) a plunger 97 which is moveable between a right position (not shown) and a left position (shown in FIG. 5) and which is operably engageable with the moveable switch contact 90 such that the switch 86 is open when the plunger 97 is in its right position and is closed when the plunger 97 is in its left position. The sensor 70 also includes a bimetal disc 98 which is temperature-sensitive and which is operably connected to the plunger 97 such that the plunger 97 is in its right position when the temperature of the pipe 46 exceeds the predetermined temperature and such that the plunger 97 is in its left position when the temperature of the pipe 46 is beneath the predetermined temperature. Thus, the switch 86 is open when the temperature of the pipe 46 is above the predetermined temperature and is closed when the temperature of the pipe 46 is below the predetermined temperature.

The water heater 10 operates as follows. When the pilot light 29 is on, and in the absence of heat rollout, the thermocouple 66 generates a current and thereby causes the valve 53 to remain open. The thermostat 58 opens the valve 54 when the water temperature is below the above-mentioned certain temperature and closes the valve 54 when the water temperature is above the certain temperature. If the pilot light 29 goes out, the thermocouple 66 stops generating a current and thereby closes the valve 53. This prevents gas flow to the gas pipe 46 regardless of the condition of the valve 54. Gas will not flow to the burner 28 even if the water temperature falls below the certain temperature. In the event of heat rollout, i.e., when the temperature of the pipe 46 exceeds the predetermined temperature, the switch 86 opens and the circuit 62 opens. This has the same effect as when the thermocouple 66 stops generating a current. The gas valve 53 is closed and gas will not flow to the gas pipe 46 even if the water temperature falls below the certain temperature.

Figure 6:
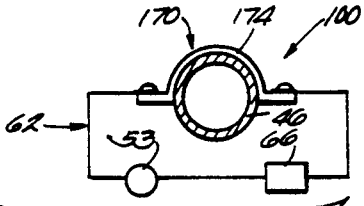
FIG. 6 is a view similar to FIG. 4 showing an alternative embodiment of the invention.

A water heater 100 that is an alternative embodiment of the invention is illustrated in FIG. 6. Except as described below, the water heater 100 is substantially identical to the water heater 10, and common elements have been given the same reference numerals.

The water heater 100 comprises a sensor 170 instead of the sensor 70 of the water heater 10. The sensor 170 includes a conductive element 174 in direct contact with the pipe 46. In other words, the element 174 touches the pipe 46. The element 174 melts when the temperature of the pipe 46 exceeds the predetermined temperature, and the element 174 is connected in the circuit 62 in series with the thermocouple 66 and with the valve 53 (shown schematically in FIG. 6) so that the circuit 62 is opened when the element 174 melts. The gas valve 53 is therefore closed when the element 174 melts.

Various features of the invention are set forth in the following claims.

I claim:

1. A water heater comprising a tank defining a water chamber, a combustion chamber located beneath said water chamber, a flue extending through said water chamber and having a lower end communicating with said combustion chamber, a gas burner located in said combustion chamber, an outer jacket surrounding said tank and said combustion chamber, said jacket having therein an opening affording access to said burner, a door closing said opening, means for supplying gas to said burner, said supplying means including a gas conduit communicating with said burner, said conduit extending exteriorly of said jacket, and means for supplying gas to said conduit, said means for supplying gas to said conduit including a valve, and means in contact with said conduit at a point substantially spaced from said burner for disabling said means for supplying gas to said conduit when the temperature of said supplying means exceeds a predetermined temperature, said disabling means closing said valve when the temperature of said conduit exceeds a predetermined temperature, and said disabling means including a sensor in contact with said conduit, said sensor being located exteriorly of said jacket and above said door.

2. A water heater as set forth in claim 1 wherein said sensor includes a switch which opens when the temperature of said conduit exceeds said predetermined temperature.

3. A water heater as set forth in claim 2 and further comprising an electrical circuit including said switch, wherein said valve is closed when said circuit is open, and wherein said circuit opens when said switch opens.

4. A water heater as set forth in claim 3 wherein said circuit also includes a thermocouple located in said combustion chamber and connected in series with said switch.

5. A water heater as set forth in claim 1 wherein said sensor includes an element which is in direct contact with said conduit and which melts when the temperature of said conduit exceeds said predetermined temperature.

6. A water heater comprising a combustion chamber, a gas burner located in said combustion chamber, an outer jacket surrounding said combustion chamber, said jacket having therein an opening affording access to said burner, a door closing said opening, a gas inlet pipe communicating with said burner, said pipe extending exteriorly of said jacket, a gas valve for opening and closing said inlet pipe, and means in contact with said pipe exteriorly of said combustion chamber for closing said valve when the temperature of said pipe exceeds a predetermined temperature, said means including a sensor in contact with said pipe, and said sensor being located exteriorly of said jacket and above said door.

7. A water heater as set forth in claim 6 wherein said sensor includes a switch which opens when the temperature of said pipe exceeds said predetermined temperature.

8. A water heater as set forth in claim 7 and further comprising an electrical circuit including said switch, wherein said valve is closed when said circuit is open, and wherein said circuit opens when said switch opens.

9. A water heater comprising a tank defining a water chamber, a combustion chamber beneath said water chamber, a gas burner located in said combustion chamber, an outer jacket surrounding said tank and said combustion chamber, said jacket having therein an opening affording access to said burner, a door closing said opening, a gas inlet pipe communicating with said burner and extending exteriorly of said jacket, a gas valve for opening and closing said inlet pipe, and a sensor which is located exteriorly of said jacket, which is in contact with said inlet pipe, which is operably connected to said gas valve for closing said valve when the temperature of said pipe exceeds a predetermined temperature, and which is located above said door.

10. A water heater as set forth in claim 9 wherein said sensor includes a switch which opens when the temperature of said pipe exceeds said predetermined temperature.

* * * * *